United States Patent [19]

Ganon

[11] Patent Number: 5,012,541

[45] Date of Patent: May 7, 1991

[54] SLIPPER AND METHOD OF MAKING SAME

[75] Inventor: Michael H. Ganon, Bexley, Ohio

[73] Assignee: R. G. Barry Corporation, Pickerington, Ohio

[21] Appl. No.: 302,345

[22] Filed: Jan. 27, 1989

[51] Int. Cl.[5] ..... A43B 1/02

[52] U.S. Cl. ..... 12/142 G; 36/9 R

[58] Field of Search ..... 36/9 R, 7.1 R; 12/142 G

[56] References Cited

U.S. PATENT DOCUMENTS

| | | | |
|---|---|---|---|
| 347,442 | 8/1886 | Rauh | 36/9 R |
| 1,194,467 | 8/1916 | Bickford | 12/142 |
| 1,201,927 | 10/1916 | Blum | 12/142 |
| 1,262,026 | 4/1918 | Dillberg | 36/9 R |
| 1,348,941 | 8/1920 | Green | 36/9 R |
| 1,640,362 | 8/1927 | Mahler et al. | 12/142 |
| 1,754,272 | 4/1930 | Jorgensen | 12/142 |
| 1,795,305 | 3/1931 | Jacob | 36/9 R |
| 3,015,171 | 1/1962 | Kaplan | 36/9 R |
| 3,016,631 | 1/1962 | Servin | 36/9 R |
| 3,032,898 | 5/1962 | Servin | 36/9 R |
| 3,052,046 | 9/1962 | Kramer | 36/9 R |
| 3,063,074 | 11/1962 | Scholl | 12/142 |
| 3,199,132 | 8/1965 | Newman | 12/142 |
| 3,228,050 | 1/1966 | Wall | 36/142 |
| 3,491,390 | 1/1970 | Greenblatt et al. | 12/142 |

FOREIGN PATENT DOCUMENTS

| | | | |
|---|---|---|---|
| 525736 | 10/1921 | France | 36/9 R |
| 926381 | 5/1963 | United Kingdom | 36/9 R |

*Primary Examiner*—Steven N. Meyers

*Attorney, Agent, or Firm*—Watson, Cole, Grindle & Watson

[57] ABSTRACT

A method of making a slipper is disclosed. The method includes the steps of attaching a vamp, sock and outsole together, leaving an opening at the toe portion. After turning the heel portions through the opening, a filler is inserted into the opening by the use of flat clamping members. The toe portion opening is then sealed and the slipper is once again turned to yield the finished slipper.

23 Claims, 4 Drawing Sheets

SLIPPER AND METHOD OF MAKING SAME

BACKGROUND OF THE INVENTION

The invention relates to slippers, and more particularly to slippers of the ballerina type.

In the prior art, slippers of this type have employed a wrap which comprises a strip of material extending around the sole of the slipper. The wrap is pulled down by a side laster machine. The use of a stiffener such as a relatively rigid board is required in such slippers to enable the wrap to be properly pulled down. The stiffener causes the finished slipper to be stiff and difficult to flex, and also results in an unattractive square or boxy look. Furthermore, when the wrap is pulled down, it compresses the cushioning material of the slipper, resulting in a reduced cushioning effect in use and a flattened appearance when not is use.

Such prior art constructions also incorporate the undesirable feature of a vertical seam disposed on the sole of the slipper adjacent the instep. Additionally, binding is used to cover some seams, and this binding makes the slipper appear to be wider than it actually is.

SUMMARY OF THE INVENTION

The present invention overcomes the disadvantages of known slippers by providing a novel arrangement wherein the use of a wrap is eliminated. No lasting or binding is required, and there is no need to employ a stiffener or nonflexible board. The finished slipper is soft and flexible and presents a rounded rather than a square or boxy look. The cushioning material is not compressed during manufacture, and accordingly, a greater cushioning effect is obtained. The foot supporting portion of the slipper has a desirable puffy look with greater comfort.

The finished slipper has no exposed unfinished edges or vertical seams, and since no binding is utilized, the slipper has a more finished or sleek silhouette appearance and readily conforms to the shape of the foot. Additionally, the method of the invention reduces errors and problems which may occur during the manufacturing process.

The above advantages of the invention slipper are obtained by making the slipper according to a unique method wherein a vamp and a sock are attached to an outsole and pad around the heel portions thereof, leaving an opening at the toe portions thereof. The heel portion of the slipper is turned through the toe opening, and then the toe opening is permanently closed. The slipper is then turned to the right side, presenting the sleek finished appearance

DESCRIPTION OF THE PREFERRED EMBODIMENTS

As used throughout the description, the term "right side" denotes the surface of a component which faces outwardly of the slipper and which is viewed by an observer. The term "wrong side" denotes the surface of a component which faces inwardly of the slipper and which is normally not seen by an observer.

Furthermore, it will be understood that some of the components of the slippers will be slightly different for the right and left foot slippers as is well-known in the art. The methods of making the right and left slippers are substantially the same except where indicated.

Figure 1:
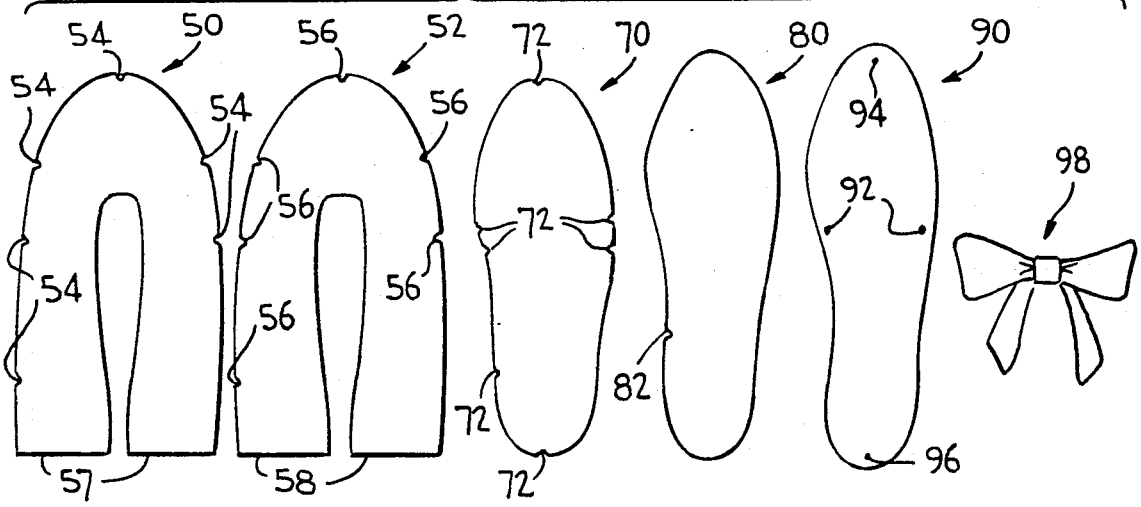
FIGS. 1-30 illustrate the method of making a ballerina type of slipper.

Referring now to the drawings wherein like reference characters designate corresponding parts throughout the several views, FIG. 1 illustrates the components from which a ballerina type of slipper is made. A vamp means is formed of a vamp 50 and a vamp lining 52 which have aligning notches 54 and 56 formed at spaced points about the peripheries thereof respectively. The vamp and vamp lining are each of generally U-shaped plan configuration and have opposite heel edges 57 and 58 respectively.

Figure 2:
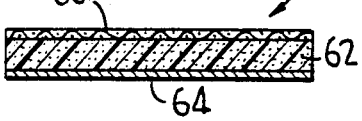

As seen in FIG. 2, vamp 50 includes a top layer 60 of conventional velour, the upper surface or right side of which is the pile side. The downwardly facing side of layer 60 is bonded by a suitable adhesive material to the upwardly facing surface of a layer of polyether synthetic foam 62 which makes the vamp puffy and soft. The downwardly facing side of layer 62 is bonded by a suitable adhesive material to the upwardly facing side of a thin tissue-like material 64 such as Pellon, a product of Haskell Lining, Inc. of New York, N.Y.

Vamp lining 52 of FIG. 1 is formed of a woven fabric which in a typical example may comprise 65% polyester and 35% cotton. The vamp and vamp lining as well as the ornamental bow described hereinafter are the only components of the slipper which are not provided in both a right and left foot version.

Figure 3:
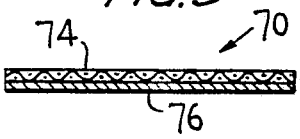

Reference character 70 designates a construction which is used both as a sock and an outsole in the invention. In other words, the sock and outsole of the slipper are of identical construction. A plurality of aligning notches 72 are formed at spaced points about the periphery of construction 70. As seen in FIG. 3, construction 70 includes a layer 74 of conventional velour, the upper surface or right side of which is the pile side. The downwardly facing side of layer 74 is bonded by a suitable adhesive material to the upwardly facing side of a thin sheet of Pellon.

Figure 4:
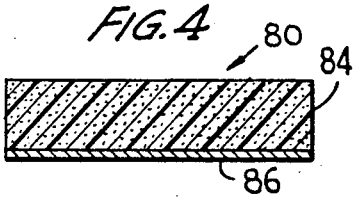

As seen in FIGS. 1 and 4, a filler means 80 is provided with an aligning notch 82 formed in the periphery thereof. The filler means includes a relatively thick layer 84 of cushioning material such as polyether synthetic foam, the downwardly facing surface of which is bonded by a suitable adhesive material to the upwardly facing surface of a thin layer 86 which forms a reinforcing means the purpose of which will hereinafter appear. Layer 86 comprises cellulose impregnated with various latex compounds to provide an elastomeric board which has a certain degree of rigidity, yet which is sufficiently flexible so as to readily deform by bending and return to its original shape after being deformed.

As seen in FIG. 1, an outsole pad 90 is formed of a suitable synthetic rubber or the like which is soft and flexible and which at the same time has good wearing qualities. The outsole pad is provided on the upwardly facing right side thereof with a pair of side outnicks or aligning marks 92, a center toe outnick 94, and a center heel outnick 96. The right side of the outsole pad may have a suitable design formed thereon. The final component of the slipper comprises an ornament in the form of a bow 98 which may be formed of suitable ribbon or the like.

Figure 5:
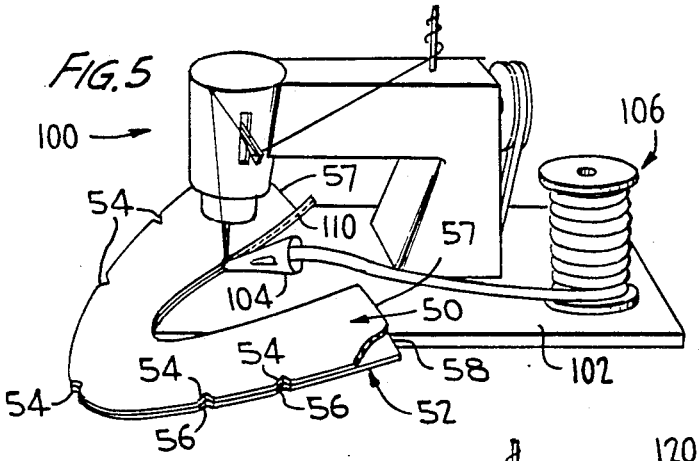
Figure 6:
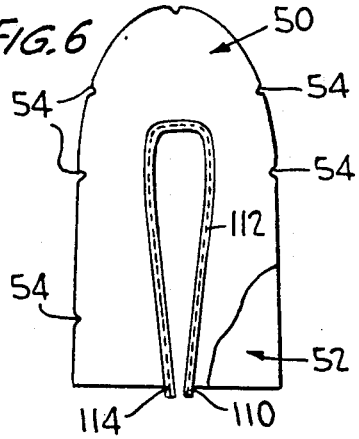

Referring now to FIGS. 5 and 6 of the drawings, a conventional chainstitch sewing machine 100 with a supporting surface 102 is provided. The sewing machine is set up with a conventional folder with finger guide 104. A supply of elastic 106 is provided. The vamp and lining are inseamed and the elastic is applied at the same time.

The vamp lining 52 is placed on the supporting surface with the throat heel end toward the machine foot. The vamp 50 is then placed on top of the lining with the right or pile side of the velour vamp in facing relationship to the vamp lining. The edges of the vamp and vamp lining are aligned using the notches 54 and 56 respectively.

One of the throat heel ends 57, 58 is placed into the elastic folder 104. The elastic is then applied around the vamp and lining throat, keeping the elastic aligned with the throat edge. Sewing is started at a point 110 at one throat heel end and a line of stitching 112 is formed as the sewing continues to a point 114 at the opposite throat heel end. The operator then chains to the next vamp and vamp lining, leaving only enough elastic between the successive vamps to trim the elastic flush to the heel contour.

Figure 7:
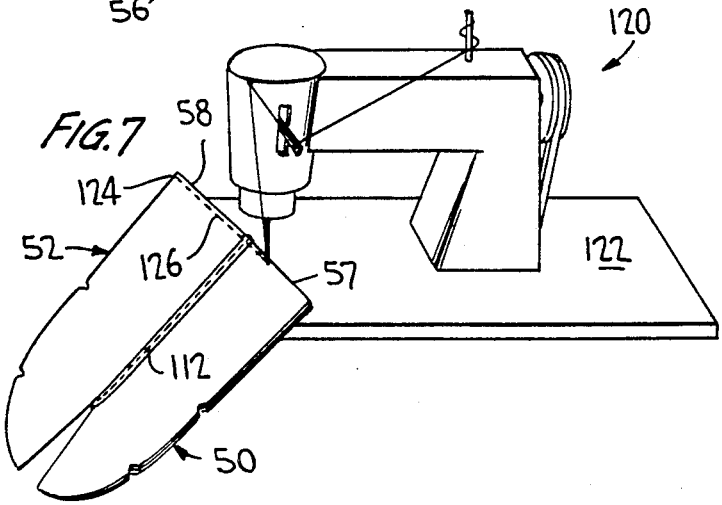
Figure 8:
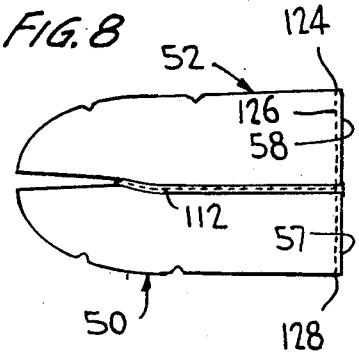

Referring now to FIGS. 7 and 8, a conventional sewing machine 120 having a supporting surface 122 is provided. The vamp and vamp lining are then folded with the vamp right or pile sides together and the lining right sides together. The wrong sides are then placed to the machine foot and the heel edges 58 of the vamp lining 52 are aligned with one another.

Sewing is then started at a point 124 at the bottom of the lining and a line of stitching 126 is formed as the sewing continues to the top of the lining. The vamp throat elastic edges and heel edges 57 are then aligned and the sewing is continued to a point 128 at the bottom of the vamp.

Figure 9:
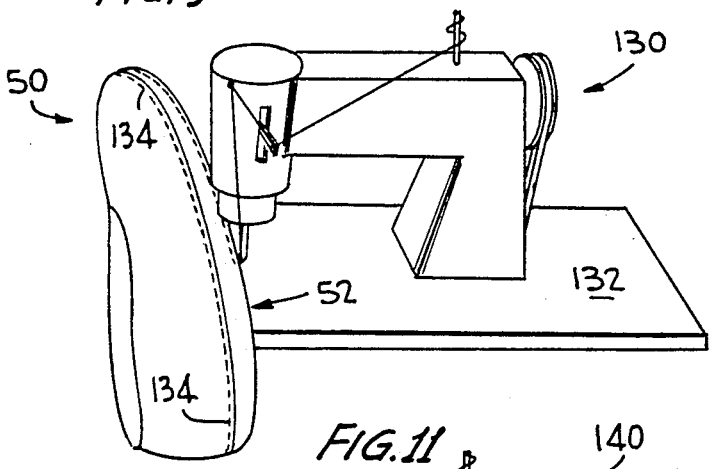
Figure 10:
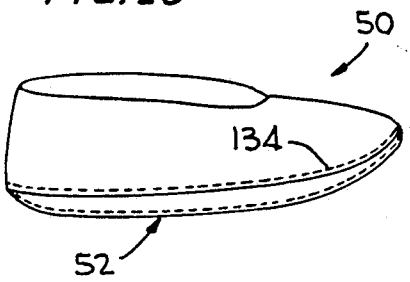

Referring now to FIGS. 9 and 10, the vamp and vamp lining are then turned with the vamp right side out and the lining right side in. A conventional sewing machine 130 with a support surface 132 is provided. The right side of lining 52 is to the machine foot; and the right side of the vamp is to the machine feed. The vamp and vamp lining heel seams are aligned with one another, and sewing is started at the heel seam toward the toe.

The side notches at one side of the vamp and lining are aligned and the sewing continues from the heel seam toward the toe. The toe notches are aligned and the sewing continues around the toe. The side notches at the opposite sides of the vamp and vamp lining are aligned and the sewing continues to the heel and past the starting point approximately ¾ inch to form a line of stitching 134. In this manner, the lining is topstitched to the bottom of the vamp.

Figure 11:
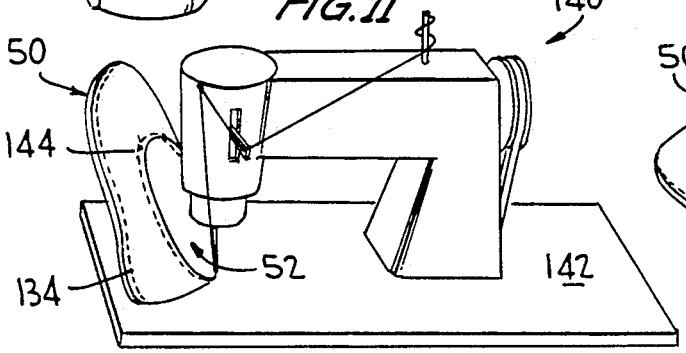
Figure 12:
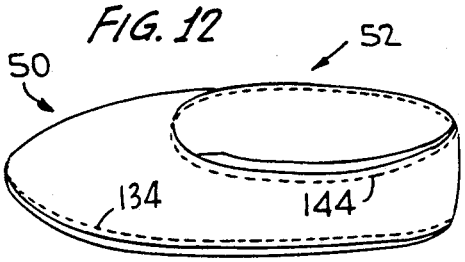

Referring now to FIGS. 11 and 12, a conventional sewing machine 140 is provided with a support surface 142. The lining right side is turned to the inside and is to the machine foot. The vamp throat is then topstitched using a guide foot to maintain an even seam and making sure that stitches do not run into the elastic.

Sewing is started about ¼ inch in front of the heel seam and continues around the throat top, maintaining the throat contour. The sewing continues past the starting point approximately ¾ inch to form a line of stitching 144.

Figure 13:
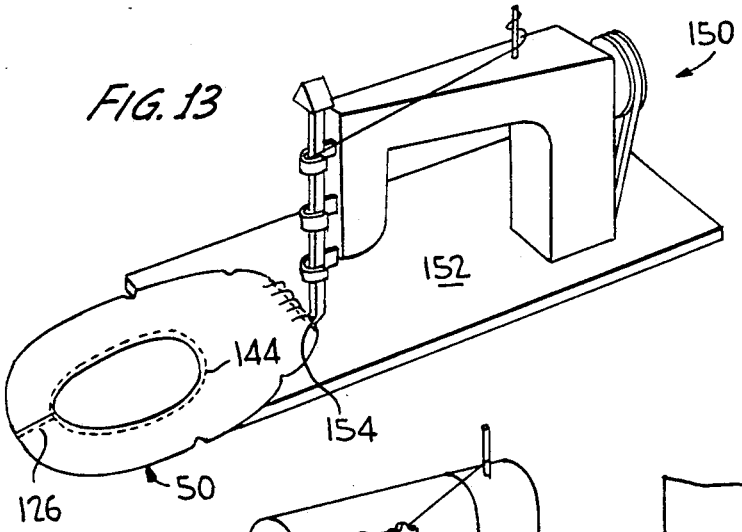
Figure 14:
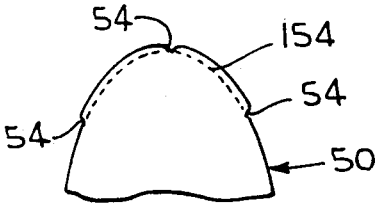

Referring now to FIG. 13, a conventional shirr machine 150 is provided with a supporting surface 152. The vamp is placed right side up on the machine with the toe toward the machine foot. Sewing is started at the vamp toe notch 54 to the left of the center toe notch as seen in FIG. 14 and continues to the toe notch 54 to the right of the center toe notch to form a line of stitching 154. This shirring gathers the toe portion of the slipper to provide fullness thereat for receiving a person's toes.

Figure 15:
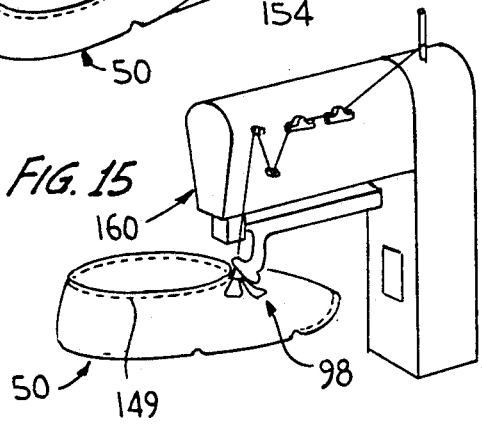
Figure 16:
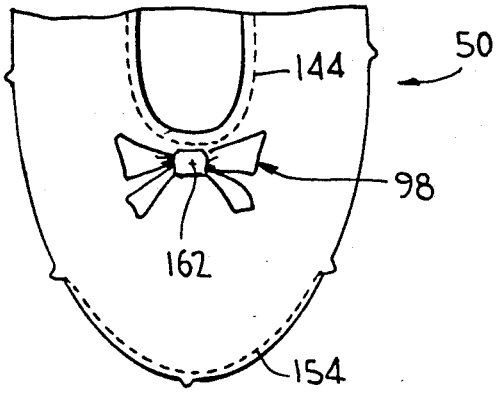

Referring now to FIGS. 15 and 16, a conventional tacker machine 160 is shown. The vamp is placed right side up on the machine with the throat center toward the machine foot. The ornamental bow 98 is premade and is placed right side up on topstitch 144 at the vamp throat center with the ends of the bow extending toward the toe. One tack 162 is then placed in the center of the bow to attach it in place.

Figure 17:
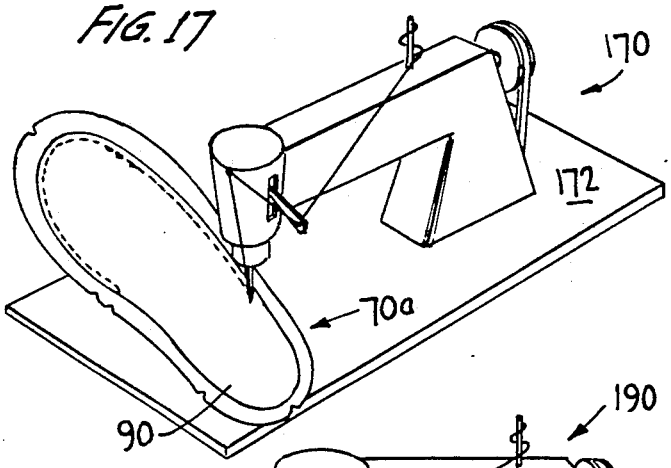
Figure 18:
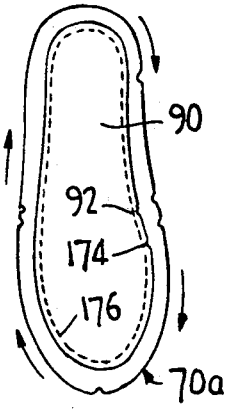

Referring now to FIG. 17, a conventional sewing machine 170 having a supporting surface 172 is provided. An outsole **70*a* identical to construction 70 previously described is provided. As seen in FIG. 18, a left outsole 70*a* is attached to a left outsole pad 90**. The outsole is disposed such that its right side is up, and the outsole pad with its right side up is then placed on the outsole in centered aligned position with the toe toward the operator.

The outsole pad may be spot glued to the outsole or otherwise held in position. Sewing is started at outnick 92 on the instep side of the outsole pad and continues toward and around the toe, thence around the outsole pad to a point 174 about ¾ inch past the starting point, thereby forming a line of stitching 176.

Figure 19:
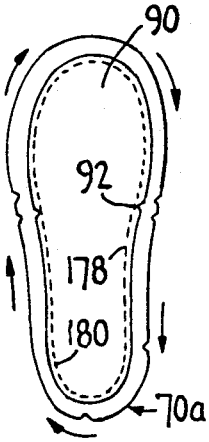

As seen in FIG. 19, a right outsole **70*a* is attached to a right outsole pad 90. The outsole is placed on the machine with the right side up, and the outsole pad is then placed on the outsole in centered, aligned position with the heel toward the operator. Sewing is started at outnick 92 on the instep side of the outsole pad and continues toward and around the heel, thence around the outsole pad to a point 178 about ¾ inch past the starting point, thereby forming a line of stitching 180**.

Figure 20:
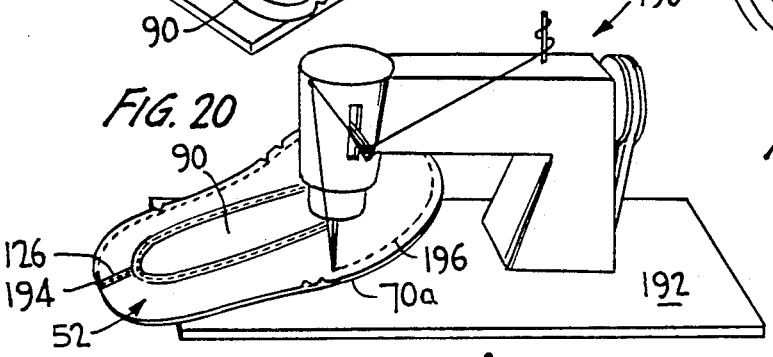
Figure 21:
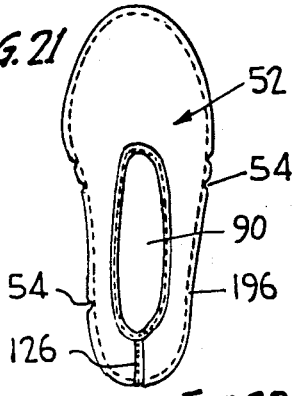

Referring now to FIGS. 20 and 21, a conventional walking foot sewing machine 190 having a supporting surface 192 is provided. The vamp means is attached to the outsole by using a low walking motion. The outsole **70*a* is placed on the machine with the right side of the outsole and outsole pad 90 right side up and with the heel toward the machine foot. The vamp means is then placed on top of the outsole with the right side of the vamp means facing the right side of the outsole, and with the vamp lining 52** facing up.

The vamp means heel seam at the line of stitching 126 is centered on the outsole center heel notch and the edges of the outsole and vamp means are aligned. These components are then sewn together starting at a point 194 adjacent the heel seam and sewing along one side toward the toe. The side notch 54 toward the heel on the vamp means is then aligned with a side notch on the outsole.

The edges are aligned, and sewing is continued toward the toe. The vamp means toe shirring is then centered on the outsole toe notch. The edges are aligned, and sewing is continued around the toe. The sewing continues in a similar manner along the opposite side back to the heel and beyond the starting point about ¾ inch to form a line of stitching 196 attaching peripheral portions of the vamp means and outsole together.

Figure 22:
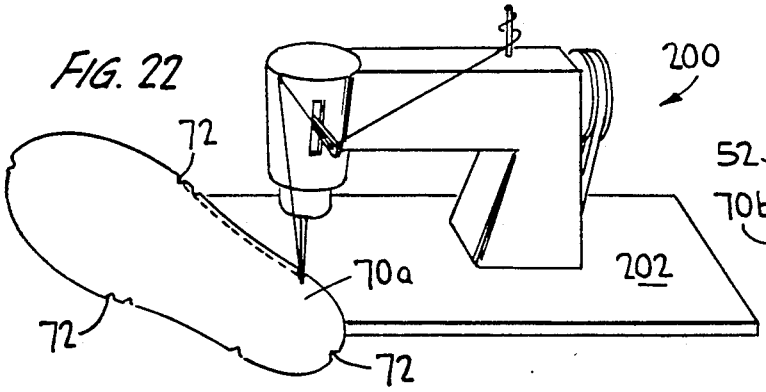
Figure 23:
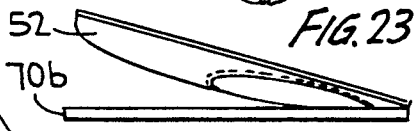

Referring now to FIG. 22, a conventional walking foot sewing machine 200 having a supporting surface 202 is provided. The machine is set up with nylon top thread, nylon bobbin and ball point needle. As seen in FIG. 23, sock 70*b* identical to construction 70 previously described is provided. The sock is placed right side up on the machine. The outsole with the attached vamp means is then placed on top of the sock with the wrong side of the vamp means facing the right side of the sock as shown. The wrong side of the outsole will be to the machine foot.

Figure 24:
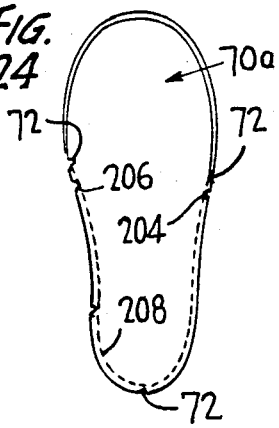

As seen in FIGS. 22 and 24, the first side notch 72 from the toe of the outsole at the right side of the outsole 70*b* is aligned with a side notch of the sock. The edges are aligned and the heel portions of the outsole and vamp means are sewn to the heel portion of the sock. Sewing is started at a point 204 to the adjacent notch 72 to form a backtack of about ½ inch. Sewing then proceeds toward the heel. The heel notch 72 of the outsole is aligned with the heel notch of the sock and sewing continues around the heel and thence toward the toe to the first side notch from the toe at the left side of the outsole.

A back tack of about ½ inch is then sewn to a point 206. In this manner a line of stitching 208 is formed attaching heel portions of the vamp means and outsole to the heel portion of the sock while leaving toe portions of the vamp means and outsole free of the toe portion of the sock to provide an opening at the toe portions.

Figure 25:
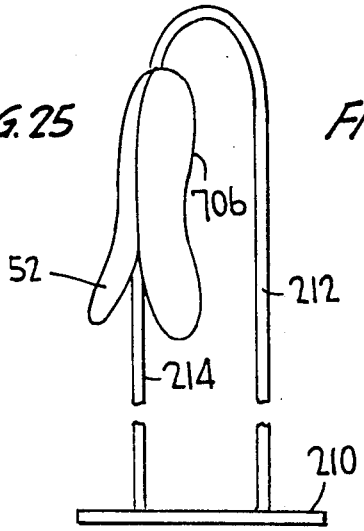
Figure 26:
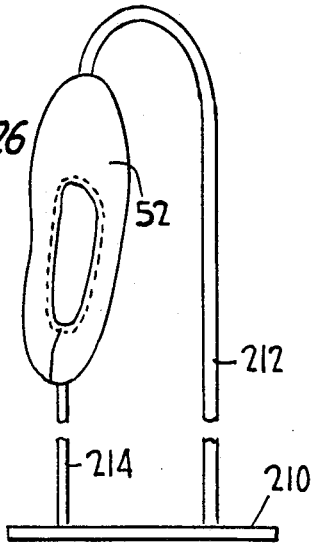

Referring now to FIGS. 25 and 26, a conventional turning machine includes a base 210, a stationary support member 212 and a vertically reciprocable rod 214 operated by a foot pedal (not shown). The slipper construction shown in FIG. 24 is then mounted on the turning machine as seen in FIG. 25. The pedal of the machine is pressed to clamp the heel of the slipper, and the slipper is pulled upwardly until the heel of the sock is turned through the toe opening to the right side as seen in FIG. 26. The vamp means is still on the wrong side. In this manner the attached heel portions of the outsole, vamp means and sock are turned through the opening at the toe of the slipper.

Figure 27:
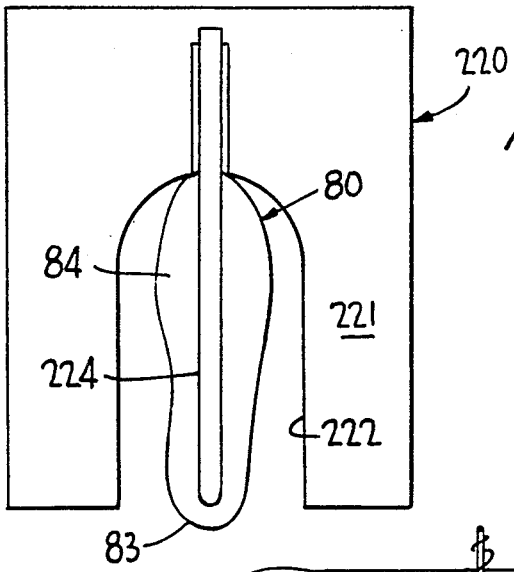
Figure 28:
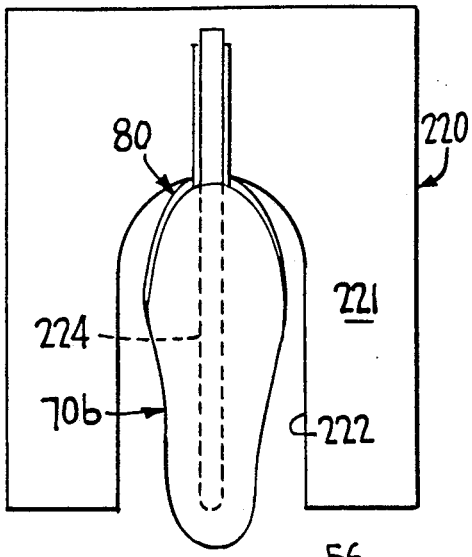

Referring now to FIGS. 27 and 28, an inserting machine 220 is shown for inserting the filler means within the slipper. The machine includes a table portion 221 and a generally U-shaped cutout area 222 into the center of which extends elongated flat clamping means 224 in the form of two flat clamping members which may be moved into and out of clamping relationship to one another. The clamping means is operated by a foot pedal (not shown).

Since the slipper and filler means are left and right, care must be taken to match them accordingly. Filler means 80 is inserted into the clamping means between the clamping members as shown in FIG. 27 with the cushioning material 84 facing up and the heel 83 toward the operator and the heel edge extending about ½ inch to ¾ inch beyond the end of the clamping means. The foot pedal is then pressed to clamp the filler means and hold it in place.

The slipper is then placed on the table with the right side of the sock 70*b* facing up. The operator grasps the sides of the slipper at the toe opening with the finger tips and with the toe opening of the slipper receiving the heel of the filler means. The slipper is then pulled over the clamping means and filler means until filler means abuts the heel edge of the slipper. Reinforcing means 86 helps maintain sufficient rigidity of the filler means during the insertion of the filler means. The foot pedal is then released so that the filler means is no longer clamped in place by the clamping means. The operator then grasps the open end of the slipper and particularly the filler means as the slipper is pulled from the clamping means of the inserting machine.

Figure 29:
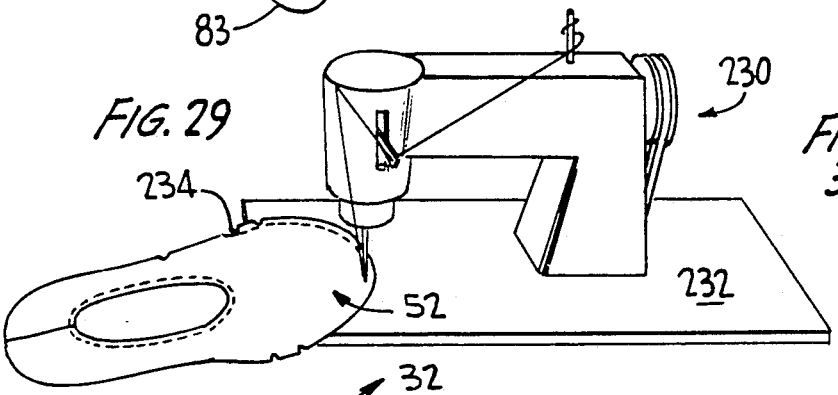
Figure 30:
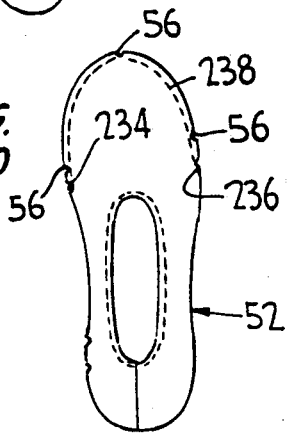

Referring now to FIGS. 29 and 30, a conventional sewing machine 230 having a supporting surface 232 is provided. The slipper is placed on the machine with the sock right side down and the vamp means wrong side to the machine foot. The toe edges of the vamp means and outsole are aligned with the toe edge of the sock and sewing is started at a point 234 about ¼ inch behind a side notch and proceeds toward the toe. The toe center notches of the vamp means and the toe center notch of the sock are aligned, and the sewing continues around the toe to a point 236 about ¼ inch past a side notch. This forms a line of stitching 238 which permanently closes the opening at the toe of the slipper.

The slipper is then turned to its right side to provide the finished slipper. A conventional toe card is then inserted in the slipper to hold the toe in position for shipping and display.

Figure 31:
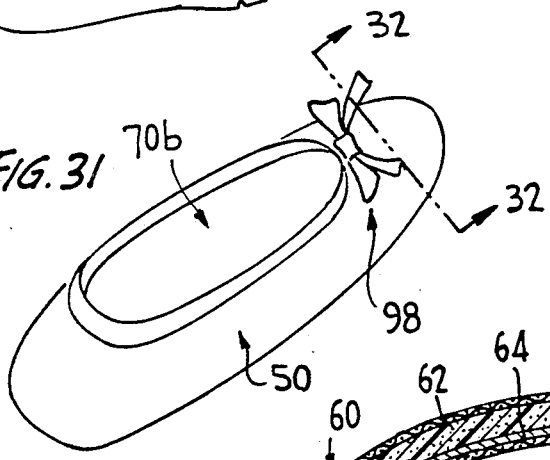
FIG. 31 is a top perspective view of a finished slipper according to the invention.
Figure 32:
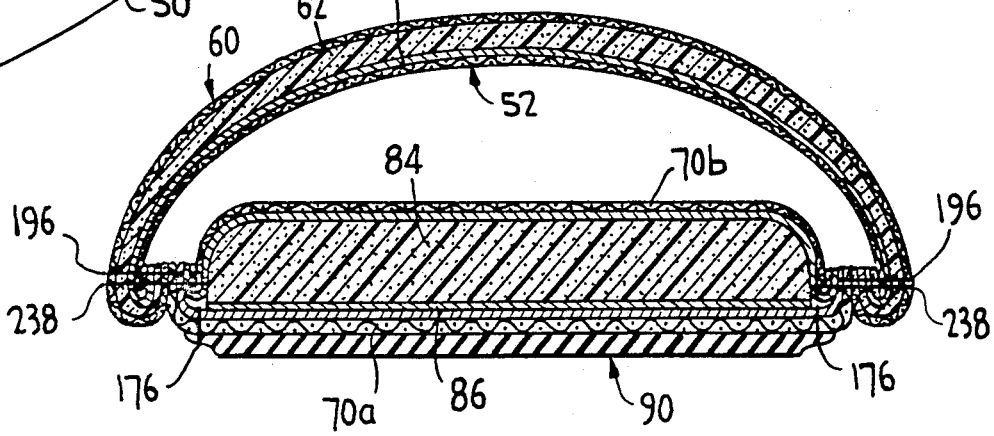
FIG. 32 is a cross-sectional view on an enlarged scale taken along line 32—32 of FIG. 31 looking in the direction of the arrows.

The finished slipper is shown in FIG. 31 and the details of the internal construction thereof can be seen in FIG. 32. The outsole 70*a* has an outsole pad 90 attached to the lower surface thereof by stitching 176 extending around a peripheral portion of the outsole. A sock 70*b* has the major part thereof spaced from the outsole, and the vamp means including elements 52, 60, 62 and 64 has a major part thereof spaced from the sock.

A filler means is disposed between the outsole and sock and includes a body of cushioning material 84 and a flexible reinforcing means 86 on the surface thereof facing the outsole. First attaching means in the form of stitching 196 attaches peripheral portions of the vamp means to peripheral portions of the outsole. Further attaching means in the form of stitching 238 attaches peripheral portions of the vamp means and the outsole to peripheral portions of the sock.

The invention has been described with reference to a preferred embodiment. Obviously, modifications, alterations and other embodiments will occur to others upon reading and understanding this specification. It is my intention to include all such modifications, alterations and alternate embodiments insofar as they come within the scope of the appended claims or the equivalent thereof.

What is claimed is:

1. The method of making a slipper comprising attaching a vamp to an outsole, attaching heel portions of said outsole and vamp to a heel portion of a sock to provide a space between said outsole and said sock and leaving an opening at the toe portions of said outsole, vamp and sock, turning said attached heel portions of said outsole, vamp and sock through said opening, providing an elongated flexible filler having a length and a width and including a toe portion and a heel portion, the filler being of such a size as to substantially fill said space, said filler comprising a thick layer of foam cushioning material and a thin layer of flexible reinforcing material, providing a clamping means including a pair of elongated substantially flat clamping members, clamping said filler between said flat clamping members along a substantial portion of the length of the filler from the toe portion of the filler to a point near the heel portion thereof, inserting the clamping members and the clamped filler through said opening into said space, unclamping said filler, removing said clamping members from said space while said filler remains within and substantially fills said space, permanently closing said opening, and turning the slipper to its right side.

2. The method as defined in claim 1 including forming said outsole, and wherenin said forming step includes securing an outsole pad to an outsole.

3. The method as defined in claim 1 wherein said vamp is attached to said outsole by placing the right side of said vamp in facing relationship to the right side of the outsole, and then sewing said vamp to the outsole along peripheral portions of said vamp and said outsole.

4. The method as defined in claim 1 wherein heel portions of said outsole and vamp are attached to a heel portion of said sock by placing the right side of the sock in facing relationship to the wrong side of the vamp and sewing the heel portions of said vamp and outsole to the heel portion of said sock.

5. The method as defined in claim 1 wherein said opening is permanently closed by attaching the toe portions of said outsole and vamp to the toe portion of said sock.

6. The method as defined in claim 1 including forming the vamp by placing the right side of a vamp in facing relationship to a vamp lining securing elastic to the throat portion of said vamp and vamp lining, and attaching additional portions of said vamp and vamp lining together.

7. The method as defined in claim 1 wherein the step of attaching additional portions of said vamp and vamp lining together comprises attaching heel edges of said vamp and vamp lining together.

8. The method as defined in claim 6 including the step of folding said vamp and vamp lining with the right sides of the vamp facing one another and right sides of the vamp lining facing one another subsequent to the step of securing elastic to the throat portions of said vamp and vamp lining and prior to the step of attaching additional portions of said vamp and vamp lining together.

9. The method as defined in claim 8 including the additional steps of turning the vamp and vamp lining inside out, and attaching lower and upper portions of the vamp and vamp lining to one another.

10. The method as defined in claim 1 wherein the inserting step includes manually grasping the sides of the slipper adjacent the opening at the toe portions, and pulling the slipper over the clamping means and the filler until the filler abuts the heel edges of the slipper.

11. The method as defined in claim 1 wherein the step of removing the clamping means from said space comprises grasping the open end of the slipper and the filler adjacent thereto, and pulling the slipper away from the clamping means.

12. The method of making a slipper comprising attaching an outsole to an outsole pad, forming a vamp, attaching said vamp to said outsole, attaching heel portions of said outsole and vamp to a heel portion of a sock to provide a space between said outsole and said sock and leaving the toe portions of said outsole and vamp free of the toe portion of said sock to provide an opening at said toe portions, turning said heel portions through said opening, providing an elongated flexible filler having a length and a width and including a toe portion and a heel portion, the filler being of such a size as to substantially fill said space, said filler comprising a thick layer of foam cushioning material and a thin layer of flexible reinforcing material, providing a clamping means including a pair of elongated substantially flat clamping members, clamping said filler between said flat clamping members along a substantial portion of the length of the filler from the toe portion of the filler to a point near the heel portion thereof, inserting the clamping members and the clamped filler through said opening into said space, unclamping said filler, removing said clamping members from said space while said filler remains within and substantially fills said space, attaching the toe portions of said outsole and vamp to the toe portion of said sock, and turning the slipper inside out to its right side.

13. The method as defined in claim 10 wherein said outsole is attached to said outsole pad by sewing peripheral portions of the outsole pad to said outsole.

14. The method as defined in claim 12 wherein said vamp is attached to said outsole by placing the right side of said vamp in facing relationship to the right side of the outsole and outsole pad, and then sewing said vamp to the outsole along peripheral portions of said vamp and said outsole.

15. The method as defined in claim 12 wherein heel portions of said outsole and vamp are attached to a heel portion of said sock by placing the right side of the sock in facing relationship to the wrong side of the vamp and sewing the heel portions of said vamp and outsole to the heel portion of said sock.

16. The method as defined in claim 12 including forming the vamp by placing the right side of a vamp in facing relationship to a vamp lining, securing elastic tot he throat portions of said vamp and vamp lining, and attaching additional portions of said vamp and vamp lining together.

17. The method as defined in claim 16 wherein the step of attaching additional portions of said vamp and vamp lining together comprises attaching heel edges of said vamp and vamp lining together.

18. The method as defined in claim 16 including the step of folding said vamp and vamp lining with the right sides of the vamp facing one another and right sides of the vamp lining facing one another subsequent to the step of securing elastic to the throat portions of said vamp and vamp lining and prior to the step of attaching additional portions of said vamp and vamp lining together.

19. The method as defined in claim 18 including the additional steps of turning the vamp and vamp lining inside out, and attaching lower and upper portions of the vamp and vamp lining to one another.

20. The method as defined in claim 12 including the additional step of shirring the toe portion of the vamp.

21. The method as defined in claim 12 including the additional step of attaching an ornament to said vamp.

22. The method as defined in claim 12 wherein the inserting step includes manually grasping the sides of the slipper adjacent the opening at the toe portions, and pulling the slipper over the clamping means and the filler until the filler abuts the heel edge of the slipper.

23. The method as defined in claim 12 wherein the step of removing the clamping means from said space comprises grasping the open end of the slipper and the filler adjacent thereto, and pulling the slipper away form the clamping means.

* * * * *